United States Patent [19]

Maruo et al.

[11] Patent Number: 4,946,412

[45] Date of Patent: Aug. 7, 1990

[54] SWIMMING AID

[75] Inventors: Yoshinobu Maruo; Tsuyoshi Maeda, both of Kanagawa, Japan

[73] Assignee: Nissan Shatai Company, Limited, Kanagawa, Japan

[21] Appl. No.: 217,333

[22] Filed: Jul. 11, 1988

[51] Int. Cl.[5] ..... B63C 11/00

[52] U.S. Cl. ..... 441/135; 114/66

[58] Field of Search ..... 114/315, 66; 441/135, 441/129

[56] References Cited

U.S. PATENT DOCUMENTS 3,204,596 9/1965 Fallon ..... 114/315

FOREIGN PATENT DOCUMENTS 59-4247 5/1959 Italy ..... 114/315
1397456 6/1975 United Kingdom ..... 441/135
2188881 10/1987 United Kingdom ..... 441/135

*Primary Examiner*—Joseph F. Peters, Jr.
*Assistant Examiner*—Jesûs D. Sotelo
*Attorney, Agent, or Firm*—Bachman & Lapointe

[57] ABSTRACT

A swimming aid comprises a floating body and a bottom viewer and may be used at a swimming pool or in the sea. The floating body is U-shaped in cross section and has a hood at the top thereof. The floating portion buoyantly supports the upper half of the swimmer's body in the water. The bottom viewer is made of a transparent material such as vinyl chloride resin and takes the form of a dome. The bottom viewer is installed on the top of the hood and provides a wide forward or underwater view of the swimmer. The swimmer when laying with his body on the bottom of the floating body can swim without great resistance while looking forward or downwardly underwater through the bottom viewer.

8 Claims, 3 Drawing Sheets

PRIOR ART

SWIMMING AID

BACKGROUND OF THE INVENTION

The present invention relates generally to a swimming aid, and more particularly, to a swimming aid provided with a floating member for floating the upper half of swimmer's body and a bottom viewer for providing a wide visual field forward and underwater.

A conventional type inflatable swimming aid, as shown in FIG. 6 is well known in the art.

Such swimming aids are generally made of vinyl chloride resin, and comprise a plurality of hollow floatation portions 01 and a bottom viewer 02 made of transparent vinyl chloride resin. The bottom viewer 02 is provided at the front portion of the boat. A swimmer can see underwater through the bottom viewer 02. It will be appreciated that the swimmer must lay with his upper body on the central floating portions 01 so as to position his head above the bottom viewer 02.

The above described conventional swimming aid has, however, some problems. First, since the floating portions 01 are made of thin vinyl chloride resin which is very flexible, the boat tends to bend due to waves or the swimmer's weight and therefore is not very stable. Since the swimming aid is substantially flat, the swimmer tends to fall off of it when the aid is inclined by force of waves, in addition, water tends to stay in the bottom viewer portion, thereby degrading visibility. Furthermore, the drag of the conventional inflatable aid in the water is great. It will be noted that in the conventional swimming aid, the boat is relatively difficult to propel due to this great drag. Further, since it is inflatable, if it is punctured or otherwise caused to loose air it will become useless.

SUMMARY OF THE INVENTION

It is an object of the present invention to provide an improved swimming aid having reduced drag and improved forward viewing characteristics.

According to an aspect of the present invention, there is provided a swimming aid comprising, a rigid body receiving portion for receiving the upper half of a swimmer's body, a hollow bottom viewer, provided at one end of the body, for providing forward and underwater view to the swimmer, and floatation means for providing buoyancy to the body.

BRIEF DESCRIPTION OF THE DRAWINGS

The present invention will be understood from the detailed description given hereinbelow and from the accompanying drawings of the preferred embodiment but are for explanation and understanding only.

DESCRIPTION OF THE PREFERRED EMBODIMENT

Figure 1:
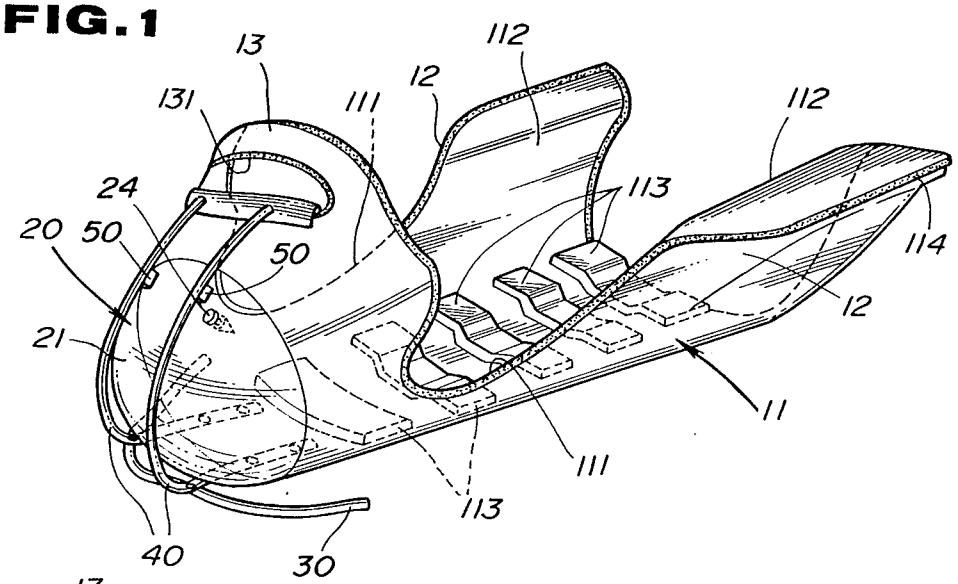
FIG. 1 is a perspective view showing a swimming aid of a first embodiment according to the invention.

Referring now to the drawings, particularly to FIGS. 1 to 4, there is illustrated a swimming aid of a first embodiment according to the present invention.

The swimming aid comprises a base body 11, floatation tanks 12, a bottom viewer 20, and a hood 13. The swimming aid, as can be seen in FIG. 2, supports the upper half of swimmer's body.

The base body 11 which is generally "U" shaped in cross section is made of rigid resin and is formed as a hollow structure to provide buoyancy thereto. The body 11 receives the breast and belly of a swimmer A and prevents him from falling into the water. As shown in FIG. 2 and 3, cutaway portions 111 provided in the base body 11 enable the swimmer A to extend his arms therethrough. Side supporting portions 112 extend upwardly so as to support the swimmer's sides. Installed on the bottom of the base body 11 is a plurality of strip-shaped pads 113 which are made of sponge rubber. The pads 113 elastically support the swimmer's body and prevent it from slipping on the base body 11.

Figure 4:
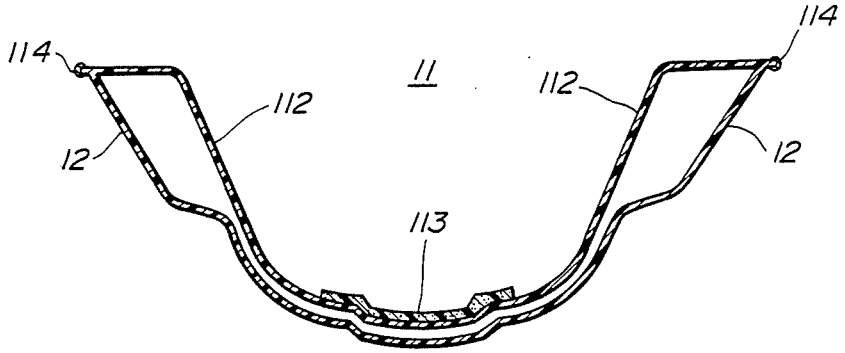
FIG. 4 is a transverse sectional view of a swimming aid.

Provided at the peripheral edge of the floating body 11 is a molding 114 made of rubber, which prevents the swimmer A from being chafed or injured by the sharp edge of the floating body. The floating portions 12 essentially provide buoyancy to the body 11. As shown in FIG. 4, the floatation tanks 12 are integrally formed with the body 11 at the outside of the side supporting portions 112.

Figure 2:
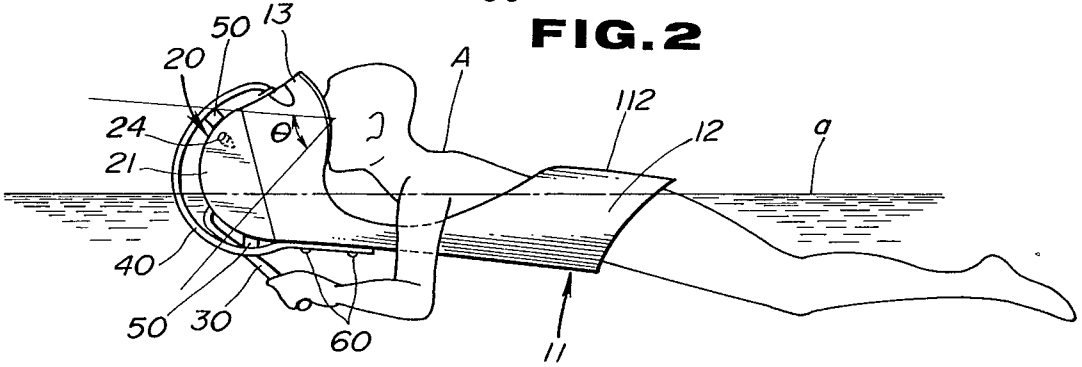
FIG. 2 is a view showing a swimmer using a swimming aid.
Figure 3:
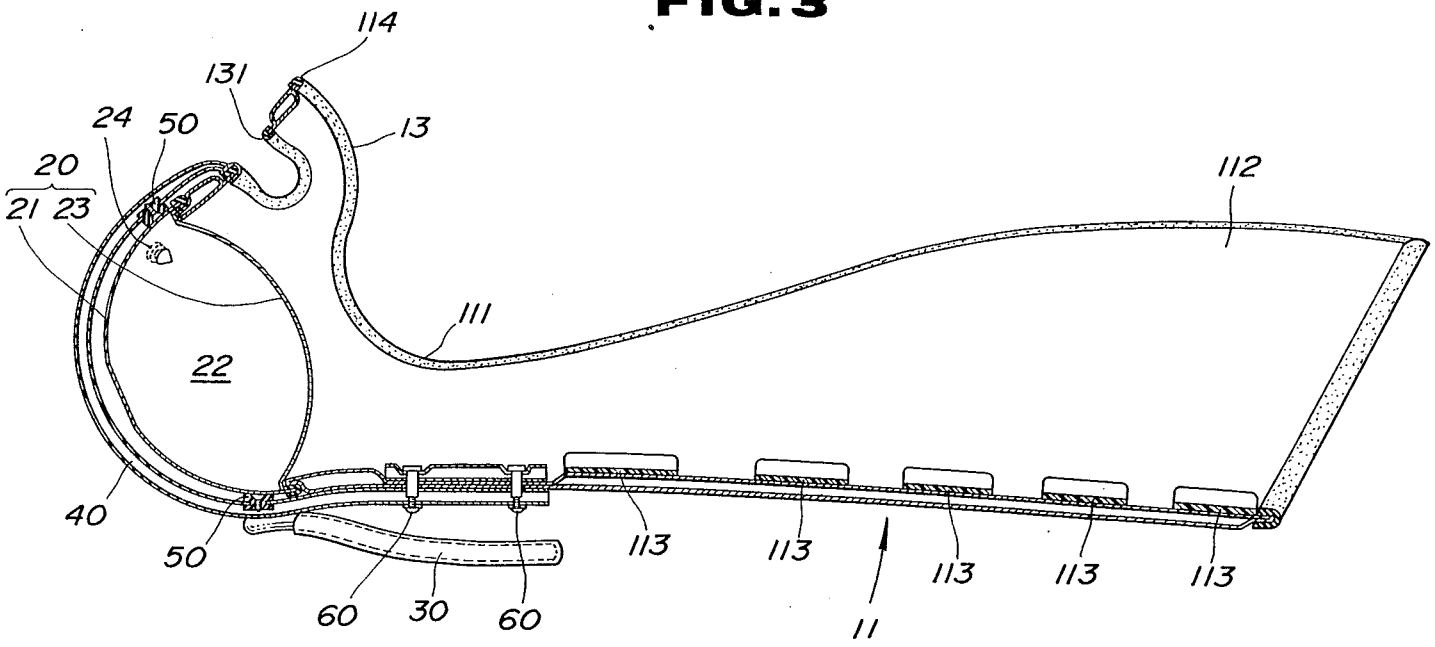
FIG. 3 is a longitudinal sectional view of a swimming aid.

The hood 13, as shown in FIG. 1 to 3, is provided so as to partially enclose the swimmer's head when he lies on his belly. The hood 13 includes an opening 131 which may serve as a grip. Thus, the opening may facilitate carrying of the swimming aid. The bottom viewer 20 which is made of a transparent resin is provided in front of the base body 11. As can be seen in FIGS. 1 and 3, the bottom viewer 20 comprises a dome portion 21 and a flat lid 23. The lid 23 covers the peripheral edge to form a sealed chamber 22. The bottom viewer 20 is slightly inclined downward so as to facilitate easy viewing the bottom of the water. It will be appreciated that since the chamber 22 provides buoyancy to the swimming aid, the floatation tanks 12 may be of reduced size, enabling the overall size, and therefore, also the drag of the swimming aid to be reduced. Provided at the upper both sides of the bottom viewer 20 are bungs 24, which are in the form of like barbs. When the inner surface of the dome portion 21 is clouded, moisture within the chamber 22 may be released by removing the bungs 24.

As shown in FIG. 1, two curved bars 40 extend downwardly from the lower edge of the opening 131 in front of the chamber 22 and the ends of the bars are fixed to the bottom of the base body 11 by means of screws 60. Rubber buffers 50 are interposed between the curved bars and the dome portion 21 at the upper and lower portions of the dome and are connected to the curved bars 40 by means of screws. It will be appreciated that when the swimming aid is collided with, for example, a rock, the curved bars function as guards for guarding the dome portion against damage, the rubber buffers 50 absorbing shock caused by collision. Also, the bars 40 may be used as grips when carrying the swimming aid. Connected to the lower side of the bars 40 is a pair of gripping handles 30. The swimmer A can balance himself by gripping the ends of the handles 30 while swimming. The curved bars 40 and the gripping handles 30 are preferably made of metal pipe covered with rubber.

Operation of the swimming aid will be described hereinbelow.

As shown in FIG. 2, the swimmer A lies with his breast and belly on the bottom of the base body 11 and extends his arms through the cutaways 111 towards the outside to grip the ends of the gripping handles 30. The swimmer A can look ahead and underwater through the bottom viewer 20 within the range of $\theta$ while swimming. In this manner, the swimmer's body is buoyantly supported in the water due to buoyancy of the chamber 22 and the floatation tanks 12.

The pads 113 elastically and comfortably support of the swimmer's breast and belly, so that the swimmer A can swim without feeling the hardness of the body 11. The pads 113, by preventing the swimmer'body from slipping, also help to maintain swimming stability. The structure of the swimming aid is rigid and is essentially uneffected by the weight of the swimmer's body or waves and the swimmer's body is received within an essentially U-shaped supporting structure defined at the sides by portions 112. Therefore, even if the swimming aid takes a wave broadside, the side supporting portions 112 prevent the swimmer's body from falling out of the aid.

The hood 13 prevents the swimmer's face and the surface of the lid 23 from being splashed by the waves from ahead.

Therefore, the swimmer A can swim in the water without great resistance. The swimmer can steer by changing his balance.

The lowermost edge of the clear viewing field through the window defined by the bottom viewer 20 is defined by a line from the viewers eyes to the water line on the inner side of the bottom viewer. In FIG. 2, the field vision $\theta$ of the first embodiment is shown.

Figure 5:
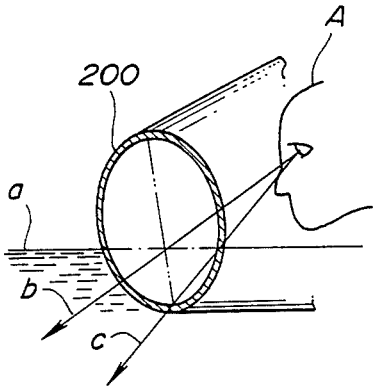
FIG. 5 is a longitudinal sectional view of a second embodiment of a swimming aid having an oval bottom viewer.
Figure 6:
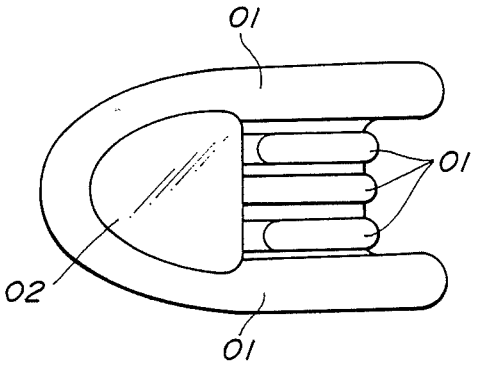
FIG. 6 is a plane view showing a conventional swimming aid.

In a second embodiment of the invention shown in FIG. 5, the portions other than the bottom viewer 200 are the same as the first embodiment and are therefore shown schematically for simplicity.

As can be seen from FIG. 5, the viewer 200 takes the form of an ovoid bubble. With this configuration the point where the inner side of bottom viewer meets the water line is much further rearwards than that of the bottom viewer 20. Thus the lower limit of the field vision shown by line C in FIG. 5 is much lower than that, line b, which would occur with the flat inner lid 23 of the bottom viewer of the first embodiment.

While the present invention has been described with respect to specific embodiments thereof, it is evident that many alternatives, modifications, and variations will be apparent to those skilled in the art. For example, the bottom viewer 20 or 200 and the base body 11 may take various shapes. While in the above described embodiment the buoyancy is provided by integrally formed floatation tanks, it will be obvious to those skilled in the art that floatation may alternatively be provided by seperately formed foam members attached to the swimming aid.

What is claimed is:

1. A buoyant swimming aid comprising:

a rigid body receiving portion for receiving the upper half of a swimmer's body;

a hollow bottom viewer, provided at one end of said body receiving portion, for providing forward and underwater view to the swimmer, said bottom viewer defining a sealed chamber and providing buoyancy to said body receiving portion;

floatation means for providing buoyancy; and wherein said chamber includes a transparent dome-shaped member and a flat transparent lid member attached on the peripheral edge of said dome-shaped member.

2. A swimming aid as set forth in claim 1, further comprising a non-slipping member for preventing a swimmer from slipping, said member being arranged on the bottom of said body receiving portion.

3. A swimming aid as set forth in claim 1, wherein said body receiving portion further comprises a hood at least partially enclosing the surface of said flat lid member.

4. A swimming aid as set forth in claim 3, wherein said body receiving portion has side walls extending upward from the water line.

5. A swimming aid as set forth in claim 4, further comprising cutaway portions defined between said hood and said side walls at each side thereof.

6. A swimming aid as set forth in claim 3, further comprising a curved bar extending downwardly from upper portion of said hood so as to guard the outer surface of said bottom viewer.

7. A buoyant swimming aid comprising:

a rigid body receiving portion for receiving the upper half of a swimmer's body;

a hollow bottom viewer, provided at one end of said body receiving portion, for providing forward and underwater view to the swimmer, said bottom viewer defining a sealed chamber and providing buoyancy to said body receiving portion;

floatation means for providing buoyancy;

a gripper arm provided for the swimmer so as to balance himself while laying on said body receiving portion when swimming; and wherein said body has cutaway portions, whereby the swimmer laying on said body receiving portion may extending his both arms to said gripping arm through said cutaway portions.

8. A buoyant swimming aid comprising:

a rigid body receiving portion for receiving the upper half of a swimmer's body;

a hollow bottom viewer, provided at one end of said body receiving portion, for providing forward and underwater view to the swimmer;

floatation means for providing buoyancy; and wherein said body receiving portion has side walls extending upward from the water line, wherein said side walls define a floatation tank so as to provide buoyancy to said body receiving portion, wherein said body receiving portion further comprises a hood, and further comprising cutaway portions defined between said hood and said side walls at each side thereof.

* * * * *